US008304151B2

(12) United States Patent
Yu et al.

(10) Patent No.: US 8,304,151 B2
(45) Date of Patent: Nov. 6, 2012

(54) CORONA AND WEAR RESISTANT IMAGING MEMBER

(75) Inventors: Robert C. U. Yu, Webster, NY (US); Stephen T. Avery, Rochester, NY (US); Jimmy E. Kelly, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 486 days.

(21) Appl. No.: 12/628,058

(22) Filed: Nov. 30, 2009

(65) Prior Publication Data

US 2011/0129769 A1 Jun. 2, 2011

(51) Int. Cl.
*G03G 5/047* (2006.01)
*G03G 5/14* (2006.01)

(52) U.S. Cl. ..... 430/58.8; 430/66; 430/59.6; 430/58.05; 430/970

(58) Field of Classification Search ..... 430/58.05, 430/59.6, 58.8, 970, 66
See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 4,286,033 | A | 8/1981 | Neyhart et al. | |
| 4,291,110 | A | 9/1981 | Lee | |
| 4,338,387 | A | 7/1982 | Hewitt | |
| 4,464,450 | A | 8/1984 | Teuscher | |
| 4,518,669 | A | 5/1985 | Yashiki | |
| 4,579,801 | A | 4/1986 | Yashiki | |
| 4,587,189 | A | 5/1986 | Hor et al. | |
| 4,664,995 | A | 5/1987 | Horgan et al. | |
| 4,775,605 | A | 10/1988 | Seki et al. | |
| 4,921,773 | A | 5/1990 | Melnyk et al. | |
| 5,017,449 | A | 5/1991 | Yoshihara | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,344,734 | A | 9/1994 | Monbaliu et al. | |
| 5,489,496 | A | 2/1996 | Katayama et al. | |
| 5,641,599 | A | 6/1997 | Markovics et al. | |
| 5,656,407 | A | 8/1997 | Kawahara | |
| 5,721,080 | A | 2/1998 | Terrell et al. | |
| 5,756,245 | A | 5/1998 | Esteghamatian et al. | |
| 5,942,361 | A * | 8/1999 | Hoshizaki et al. | 430/58.7 |
| 6,180,309 | B1 | 1/2001 | Maty et al. | |
| 6,200,716 | B1 | 3/2001 | Fuller et al. | |
| 6,207,334 | B1 | 3/2001 | Dinh et al. | |
| 6,326,111 | B1 * | 12/2001 | Chambers et al. | 430/58.05 |
| 6,337,166 | B1 | 1/2002 | Chambers et al. | |
| 7,008,741 | B2 | 3/2006 | Yu et al. | |
| 7,018,756 | B2 | 3/2006 | Pai et al. | |
| 7,413,835 | B2 | 8/2008 | Lin et al. | |
| 2004/0214100 | A1 * | 10/2004 | Yu et al. | 430/58.8 |
| 2005/0164104 | A1 * | 7/2005 | Tong et al. | 430/58.05 |
| 2007/0015073 | A1 * | 1/2007 | Lin et al. | 430/58.75 |
| 2009/0253056 | A1 * | 10/2009 | Yu | 430/58.05 |
| 2009/0253059 | A1 * | 10/2009 | Yu et al. | 430/58.8 |
| 2011/0053068 | A1 * | 3/2011 | Yu et al. | 430/58.55 |
| 2011/0053069 | A1 * | 3/2011 | Yu et al. | 430/59.6 |

* cited by examiner

*Primary Examiner* — Christopher Rodee
(74) *Attorney, Agent, or Firm* — Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to the incorporation of an ozone quenching compound into the charge transport layer to quench the corona effluents and protect the polycarbonate binder of the charge transport layer from being attacked by ozone species, thereby enhancing wear resistance and fatigue cracking.

20 Claims, 2 Drawing Sheets

CORONA AND WEAR RESISTANT IMAGING MEMBER

BACKGROUND

The presently disclosed embodiments are directed to a wear and cracking imaging member with extended life used in electrostatography. More particularly, the disclosure embodiments pertain to the formulation of a mechanical function improved electrophotographic imaging member by (1) creating a corona resistant charge transport layer by incorporating an ozone quenching compound and also with (2) the inclusion of a mechanically robust protective overcoat layer to add complementary enhancement effect for achieving the imaging member's wear life extension as well as providing a methodology for making and using the member.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrostatographic imaging members are typically in either rigid drum design or a flexible belt configuration and they are well known in the art. Typical electrostatographic imaging members include, for example: (1) electrophotographic imaging members (photoreceptors) commonly utilized in electrophotographic (xerographic) processing systems; (2) electroreceptors such as ionographic imaging members for electrographic imaging systems; and (3) intermediate transfer members such as an intermediate toner image transferring member which is used to remove the toner images from a photoreceptor surface and then transfer the very images onto a receiving paper. Although the scope of the present disclosure covers the preparation of all types of electrostatographic imaging members, however for reason of simplicity, the embodiments and discussion thus followed hereinafter will be focused and represented solely by electrophotgraphic imaging member in both rigid drum and flexible belt configurations.

Electrophotographic flexible belt imaging members may include a photoconductive layer including a single layer or composite layers. Typical electrophotographic imaging member belts include a charge transport layer and a charge generating layer on one side of a flexible supporting substrate layer and an anticurl back coating coated onto the opposite side of the substrate layer. However, a typical electrographic imaging member belt does have a more simple material structure; it includes a dielectric imaging layer on one side of a flexible supporting substrate and an anti-curl back coating on the opposite side of the substrate to render flatness.

Since both flexible electrophotographic imaging member belts and flexible electrographic imaging member belts do exhibit undesirable upward imaging member curling after completion of the electrically active coating layer(s), an anticurl back coating, applied to the backside, is required to balance the curl; the application of the anticurl back coating is therefore necessary to provide the appropriate imaging member belts with desirable flatness. The flexible electrophotographic imaging member belts and flexible electrographic imaging member belts may be seamless or seamed belts; and seamed belts are usually formed by cutting a rectangular sheet from a web, overlapping opposite ends, and welding the overlapped ends together to form a welded seam. By comparison, electrostatographic imaging members in drum design do not required an anticurl back coating, because they all have a rigid substrate drum to support the applied coating layer(s). When functioned under the electrophotographic machine service conditions, the imaging members do exhibit typical mechanical failures such as frictional abrasion, wear, and surface cracking. Surface cracking, frequently seen, is unique in belt members and is induced either due to dynamic fatigue belt flexing over the supporting rollers of a machine belt support module or caused by exposure to airborne chemical contaminants such as solvent vapors, and very particularly, the corona species emitted by machine charging subsystems, or exacerbated by the combination effects of fatigue belt flexing and airborne chemical exposure. Imaging member surface wear is found to be particularly severe in rigid drum design employing a contacting AC Bias Charging Roll to cause early onset of functional failure. Since theses premature mechanical failures have prevented the imaging members to reach their intended service life and very costly to have each replacement, therefore a solution to the issue is urgently needed.

One type of composite photoconductive layer used in xerography is illustrated in U.S. Pat. No. 4,265,990 which describes a negatively-charged photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer, the photoconductive layer is sandwiched between a contiguous charge transport layer and the supporting conductive layer. Alternatively, the charge transport layer of a positively-charged imaging member is sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer is sandwiched between the outermost exposed charge transport layer and the electrically conducting layer, the outer surface of the charge transport layer is charged negatively and the conductive layer is charged positively. The charge generating layer then should be capable of generating electron hole pair when exposed image wise and inject only the holes through the charge transport layer. In the alternate case when the charge transport layer is sandwiched between the charge generating layer and the conductive layer, the outer surface of Gen layer is charged positively while conductive layer is charged negatively and the holes are injected through from the charge generating layer to the charge transport layer. The charge transport layer should be able to transport the holes with as little trapping of charge as possible. In a typical flexible imaging member web like photoreceptor, the charge conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a charge generating layer, a charge transport layer and a conductive ground strip layer adjacent to one edge of the imaging layers, and an optional overcoat layer adjacent to another edge of the imaging layers. Such a photoreceptor usually further comprises an anticurl back coating layer on the side of the substrate opposite the side carrying the conductive layer, support layer, blocking layer, adhesive layer, charge generating layer, charge transport layer and other layers.

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein all incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are all herein incorporated by reference.

U.S. Pat. No. 6,326,111, the disclosure of which is entirely incorporated by herein by reference, relates to a charge transport material for a photoreceptor includes at least a polycarbonate polymer, at least one charge transport material, polytetrafluoroethylene (PTFE) particle aggregates having an average size of less than about 1.5 microns, hydrophobic silica and a fluorine-containing polymeric surfactant dispersed in a solvent. The presence of the hydrophobic silica enables the dispersion to have superior stability by preventing settling of the PTFE particles. A resulting charge transport layer produced from the dispersion exhibits excellent wear resistance against contact with an AC bias charging roll, excellent electrical performance, and delivers superior print quality.

U.S. Pat. No. 6,337,166, the disclosure of which is totally incorporated by reference, discloses a charge transport material for a photoreceptor includes at least a polycarbonate polymer binder having a number average molecular weight of not less than 35,000, at least one charge transport material, polytetrafluoroethylene (PTFE) particle aggregates having an average size of less than about 1.5 microns, and a fluorine-containing polymeric surfactant dispersed in a solvent mixture of at least tetrahydrofuran and toluene. The dispersion is able to form a uniform and stable material ideal for use in forming a charge transport layer of a photoreceptor. The resulting charge transport layer exhibits excellent wear resistance against contact with an AC bias charging roll, excellent electrical performance, and delivers superior print quality.

Lin et al., U.S. Pat. No. 7,413,835 issued on Aug. 19, 2008, discloses an electrophotographic imaging member having a thermoplastic charge transport layer comprising charge transport compound, a polycarbonate binder, a particular dispersion, and a high boiler compatible organic liquid. The disclosed charge transport layer exhibits enhanced wear resistance, excellent photoelectrical property, and good copy print out quality.

Yu et al., U.S. Pat. No. 7,008,741 issued on Mar. 7, 2006, discloses a photoconductive imaging member containing a photogenerating layer, a charge transport layer, or a plurality of charge transport layers, and which charge transport layer, especially the top charge transport layer contains a vinyl organic compound.

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein all incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are all herein incorporated by reference.

Since the outermost exposed charge transport layer of both flexible belt and rigid drum electrophotographic imaging members do exhibit pre-mature onset of abrasion/wear mechanical failure caused by corona attack, the formulation of a robust and functional charge transport layer is needed to resolve the issue. To further enhance the service life of the imaging member, a wear resistant overcoat layer may be added over the charge transport layer to provide abrasion and wear protection for further extension of the service life of the imaging members in the field.

The terms used to describe the imaging members, their layers and respective compositions, may each be used interchangeably with alternative phrases known to those of skill in the art. The terms used herein are intended to cover all such alternative phrases.

SUMMARY

According to embodiments illustrated herein, there is provided an inventive imaging member having enhanced corona and wear resistance.

In particular, an embodiment provides an imaging member comprising a substrate, a charge generating layer disposed on the substrate, and at least one charge transport layer disposed on the charge generating layer, wherein the charge transport layer comprises a polycarbonate binder, a charge transport compound of N,N'-diphenyl-N,N'-bis(3-methylphenyl)-1,1-biphenyl-4,4'-diamine, and an ozone quenching compound, and further wherein the ozone quenching compound is miscible with both the polycarbonate and N,N'-diphenyl-N,N'-bis(3-methylphenyl)-1,1-biphenyl-4,4'-diamine.

In another embodiment, there is provided an imaging member comprising a substrate, a charge generating layer disposed on the substrate, at least one charge transport layer disposed on the charge generating layer and an overcoat layer disposed over the charge transport layer, wherein the charge transport layer comprises a polycarbonate binder, a charge transport compound of N,N'-diphenyl-N,N'-bis(3-methylphenyl)-1,1-biphenyl-4,4'-diamine, and an ozone quenching compound, and further wherein the ozone quenching compound is selected from the group consisting of one of the following species represented by Formulas (I) to (XIV) below:

Formula (I)

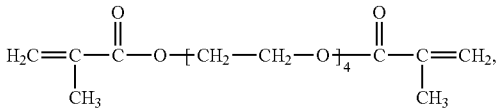

Formula (II)

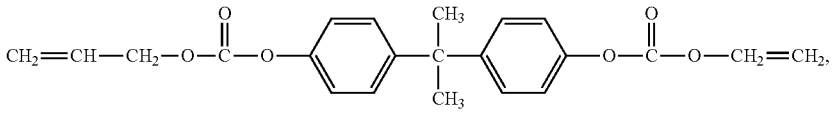

Formula (III)

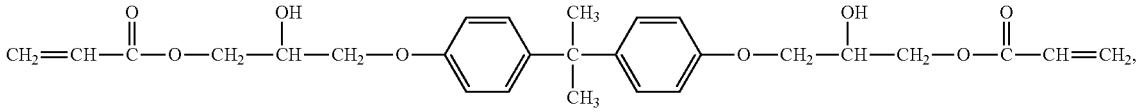

Formula (IV)

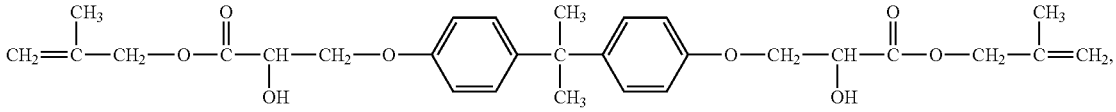

Formula (V)

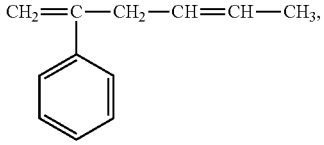

Formula (VI)

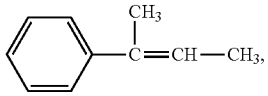

Formula (VII)

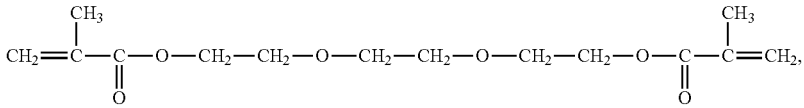

Formula (VIII)

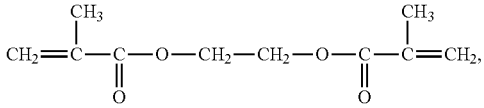

Formula (IX)

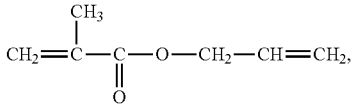

Formula (X)

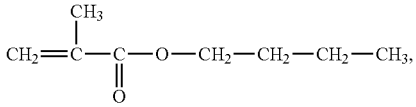

Formula (XI)

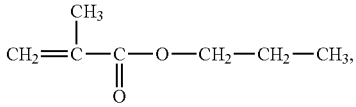

Formula (XII)

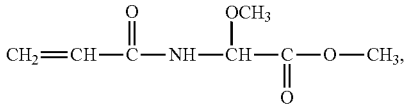

Formula (XIII)

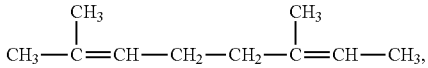

Formula (XIV)

and mixtures thereof.

In yet another embodiment, there is provided an imaging member comprising a substrate, a charge generating layer disposed on the substrate, a charge transport layer disposed on the charge generating layer, and an overcoat layer disposed on the charge transport layer, wherein the charge transport layer has multiple layers and each layer comprises a polycarbonate binder, a charge transport compound of N,N'-diphenyl-N,N'-bis(3-methylphenyl)-1,1-biphenyl-4,4'-diamine, and an ozone quenching compound, and further wherein the ozone quenching compound is selected from the group consisting of one of the following species represented by Formulas (I) to (XIV) below:

Formula (I)

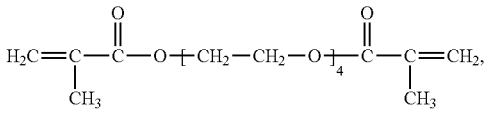

Formula (II)

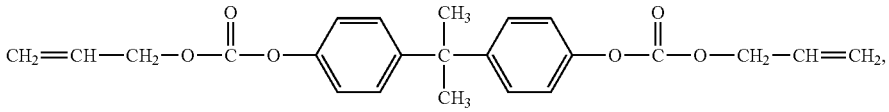

Formula (III)

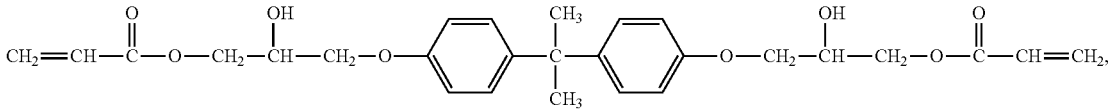

Formula (IV)

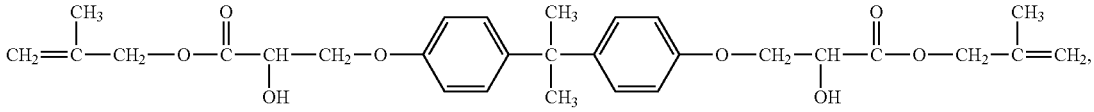

Formula (V)

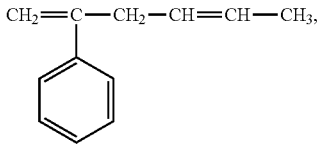

Formula (VI)

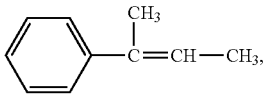

Formula (VII)

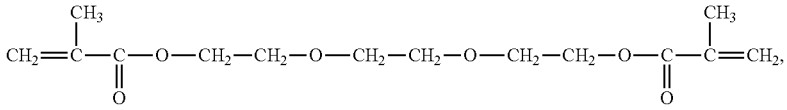

Formula (VIII)

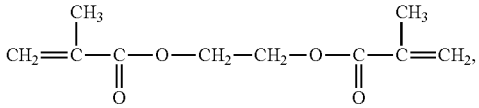

Formula (IX)

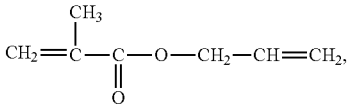

Formula (X)

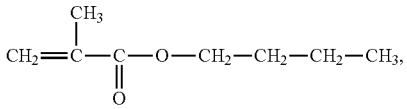

Formula (XI)

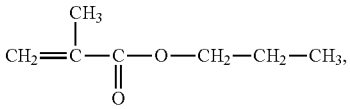

Formlula (XII)

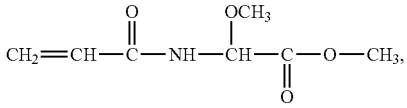

Formula (XIII)

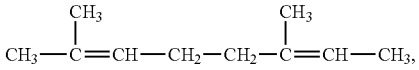

Formula (XIV)

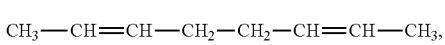

and mixtures thereof.

BRIEF DESCRIPTION OF THE DRAWINGS

For a better understanding, reference may be had to the accompanying figure.

Unless otherwise noted, the same reference numeral in different figures refers to the same or similar feature.

DETAILED DESCRIPTION

Figure 1:
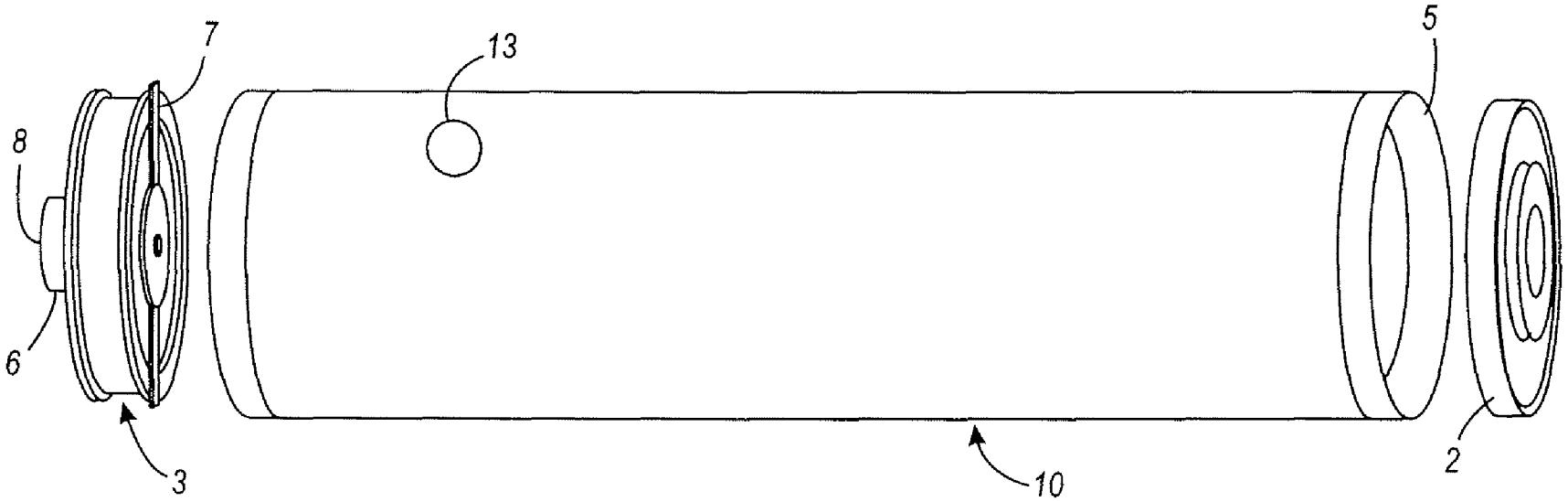
FIG. 1 is an illustration of a drum electrophotographic imaging member in accordance with the present embodiments.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

FIG. 1 is an illustration of a typical negatively charged electrophotographic imaging member showing the construction of the imaging member in drum configuration and various key layers. As shown in FIG. 1, the electrophotographic imaging member includes a rigid substrate in the shape of a rigid cylindrical imaging member drum 10, and flanges 2 and 3 fitted to the opening at each end of the imaging member drum 10. Outboard flange 2 and inboard flange 3 are mounted at the ends of the cylindrical counter bore 5 using an epoxy adhesive. Inboard flange 3 consists of a bearing 6, ground strap 7 and drive gear 8. In some designs, either flange could containing the ground strap, the drive gear and the bearing or the function can be split between the two flanges in any combination that has a spring contact to the bearing shaft and a friction contact to the inner substrate surface. The coating layers 13 of this negatively charged electrophotographic imaging member design of FIG. 1 are shown in more detail in FIG. 2.

The key layers in the present disclosure embodiments, illustrated in FIG. 2, include an organic or an inorganic release layer 9 disposed directly on the rigid conductive substrate drum 10, an undercoat layer 14 disposed on the release layer 9, and one or more electrophotographically active imaging layers 18, 20 subsequently disposed on the undercoat layer 14. The imaging layers include a charge generation layer 18 and a charge transport layer 20. In the event that the imaging member utilizes a non conductive or electrically insulative rigid support substrate 10, an electrically conductive ground plane 12 is to be included in the imaging member. The conductive ground plane 12 used is typically a thin metallic layer of approximately few hundred angstroms in thickness applied over the substrate drum 10 by vacuum deposition or sputtering process. Furthermore, the electrophotographic imaging member may also coated over with an overcoat layer 32, in addition to all the coating layers 13, to provide abrasion/wear protection to the charge transport layer.

However, if the rigid substrate support 10 used is by itself an electrically conductive substrate drum 10, the application of conductive ground plane 12 is then omitted. The conductive rigid substrate 10 may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The charge generation layer 18 and the charge transport layer 20, providing the electrophotographic imaging function, are described here as two separate layers. In a positively charged imaging member design, alternative to what is shown in the FIG. 2, the charge generation layer may also be disposed on top of the charge transport layer. Other layers of either rigid imaging member design may include, for example, an optional over coat layer 32. Overcoat layers are commonly included to increase mechanical wear and scratch resistance to prolong the service life of photoreceptor device. It will be appreciated that the functional components of charge transport layer and charge generating layer may alternatively be combined into a single layer.

For a typical flexible electrophotgraphic imaging member design, the substrate 10 used is typically a flexible insulative polymeric web of 2 to 10 mils in thickness which is then coated over with a thin metallic conductive ground plane. Since the electrophotgraphic imaging member odes exhibits spontaneous upward curling after coating the electrophotographic imaging layers, an anti-curl back coating (not shown) is needed and applied to the backside of flexible substrate 10 to balance the curl and render the imaging member flatness.

The Substrate

An electrically conducting rigid substrate 10 may be any metal, for example, aluminum, nickel, steel, copper, and the like; or a polymeric material which is filled with an electrically conducting substance, such as carbon, metallic powder, and the like, or an organic electrically conducting material. In certain embodiments, the substrate is made from aluminum or an aluminum alloy.

The electrically insulating or conductive substrate 10 may have variances of configurations which may be in the form of an endless flexible belt, a web, a rigid sheet, or a rigid cylinder, and the like. The thickness of the substrate layer depends on numerous factors, including strength desired and economical considerations. Thus, the rigid substrate 10 for a drum or a sheet, this layer may be of substantial thickness of, for example, up to many centimeters or, of a minimum thickness of less than a millimeter. By comparison, a flexible belt may substantially be of less thickness, for example, about 10 mils, or of minimum thickness less than 2 mils, provided there are no adverse functional effects on the final electrophotographic imaging member device. The wall thickness of the rigid drum substrate 10 is manufactured to be at least about 0.25 mm to fulfill the physical, dimensional, and mechanical requirements of the photoreceptor device. In one embodiment, the thickness of the rigid substrate is from about 0.25 mm to about 5 mm. In one embodiment, the thickness of the substrate is from about 0.5 mm to about 3 mm. In another embodiment, the thickness of the substrate is from about 0.9 mm to about 1.1 mm. However, the thickness of the substrate can also be outside of these ranges.

The surface of the rigid substrate 10 is polished to a mirror-like finish by a suitable process such as diamond turning, metallurgical polishing, and the like. The rigid substrate may alternatively have a roughening/texturing surface created through a glass bead honing process, or a combination of diamond turning followed by metallurgical polishing or glass bead honing to suppress light reflection from the substrate surface. Minimizing the reflectivity of the surface may eliminate defects caused by surface reflections that have the appearance of a plywood patterns in half tone areas of prints. Exceeding certain surface roughness, for example, 5 microns, may lead to undesirable and non-uniform electrical properties across the device, which cause poor imaging quality. In certain embodiments, the surface roughness of the substrate is controlled to be less than 1 microns, or less than 0.5 microns.

In the event where the substrate layer is not conductive, the surface thereof may be rendered electrically conductive by applying over it with an electrically conductive coating. The conductive coating may vary in thickness over substantially wide ranges depending upon economic factor/consideration; while in flexible belt form, the optical transparency and degree of flexibility is particularly desired.

The Release Layer

An optional release layer 9, having intrinsic hole blocking capability may also be included and coated/disposed over the rigid conductive substrate 10. Typical release layer is for example an organic material such as a gelatin release layer or an inorganic layer such as a gamma aminopropyl triethoxyl silane. The release layer 9 is positioned between the substrate and the other coating layers and may have a thickness of less than 2.0 microns; a thickness of from about 0.2 micron to about 2.0 microns, or preferably a thickness of from about 0.1 micron to about 1.0 microns.

The inclusion of a release layer 9 in the imaging member material package is for the ease/convenience of recovering/reclaim the substrate support 10 from field life-terminated as well as a production reject imaging members for subsequently be used for imaging member re-manufacturing. As substrates, such as aluminum substrates, represent about 50 percent of imaging member raw materials cost in the production of imaging members. Therefore, the inclusion of a release layer is a significant cost saving measure.

Importantly, the release layer also provides an added advantage of recovering the valuable photoelectrically activer materials, such as N,N'-diphenyl-N,N'bis(3-methylphenyl)-[1,1'-biphenyl]-4,4'diamine (m-TBD). So that after removal of the imaging member coating layers, the insoluble coating layers may be separated from the water by filtration. Next, the filtered charge transport layer is dried and the m-TBD in the charge transport layer can be obtained through solvent extraction.

The Ground Plane

In the event that an electrically insulative or non conductive substrate 10 is utilized, an electrically conductive ground plane 12 is needed and applied over the substrate prior to the subsequent application of the release layer. The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The thickness of the conductive layer 12 may be at least about 20 Angstroms, or no more than about 750 Angstroms, or at least about 50 Angstroms. Although the conductive layer may vary in thickness over substantially wide ranges for the flexible imaging member belt configuration, but no more than about 200 Angstroms is desired to impact optimum combination of electrical conductivity, flexibility, optical transparency, and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of release layer 9 the electrically conductive ground plane layer 12, the hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$ (gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and may have a thickness of from about 1 micron to about 23 microns. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

An optional separate adhesive interface layer (not shown in FIG. 2), if needed, may be provided in certain configurations, such as for example, in flexible web configurations. In the imaging member illustrated in FIG. 2, the interface layer would be situated between the blocking layer 14 and the charge generation layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer may be applied directly to the hole blocking layer 14. Thus, the adhesive interface layer in embodiments is in direct contiguous contact with both the underlying hole blocking layer 14 and the overlying charge generator layer 18 to enhance adhesion bonding to provide linkage. In yet other embodiments, the adhesive interface layer is entirely omitted.

Any suitable solvent or solvent mixtures may be employed to form a coating solution of the polyester for the adhesive interface layer. Solvents may include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Application techniques may include spraying, dip coating, roll coating, wire wound rod coating, and the like. Drying of the deposited wet coating may be effected by any suitable conventional process, such as oven drying, infra red radiation drying, air drying, and the like.

The adhesive interface layer may have a thickness of at least about 0.01 microns, or no more than about 900 microns after drying. In embodiments, the dried thickness is from about 0.03 microns to about 1 micron.

The Charge Generation Layer

The charge generation layer 18 may thereafter be applied onto the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

A number of titanyl phthalocyanines, or oxytitanium phthalocyanines for the photoconductors illustrated herein are photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the disclosures of which are totally incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the disclosure of which is totally incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of less than 1 micrometer, or about 0.25 micrometer. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 micrometer, or no more than about 5 micrometers, for example, from about 0.2 micrometer to about 3 micrometers when dry. The charge generation layer thickness is generally related to binder content. Higher binder content compositions generally employ thicker layers for charge generation.

The Ground Strip Layer

For flexible imaging member belt, a conventional ground strip layer (not shown) may also be included. The ground strip layer comprises, for example, conductive particles dispersed in a film forming binder and may be applied to one edge of the photo 1, and conductive layer 12 for electrical continuity during electrophotographic imaging process. The ground strip layer may comprise any suitable film forming polymer binder and electrically conductive particles. Typical ground strip materials include those enumerated in U.S. Pat. No. 4,664,995, the entire disclosure of which is incorporated by reference herein. The ground strip layer 41 may have a thickness from about 7 micrometers to about 42 micrometers, and more specifically from about 14 micrometers to about 23 micrometers.

The Charge Transport Layer

In either a rigid drum or a flexible belt imaging member design, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The charge transport layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case of flexible the imaging member belt that is prepared with the use of a flexible transparent substrate 10 and also a transparent or partially transparent conductive layer 12, image wise exposure or erase may be accomplished through the substrate 10 with all light passing through the back side of the substrate. In this case, the materials of the charge transport layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer binder material matrix on a molecular scale and homogeneously.

The charge transport component may be added to a film forming polymeric binder material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (m-TBD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which charge transport components are for examples the aryl amines of the following formulas/structures:

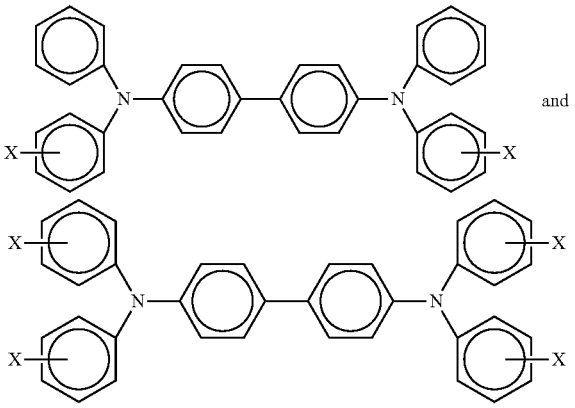

and wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

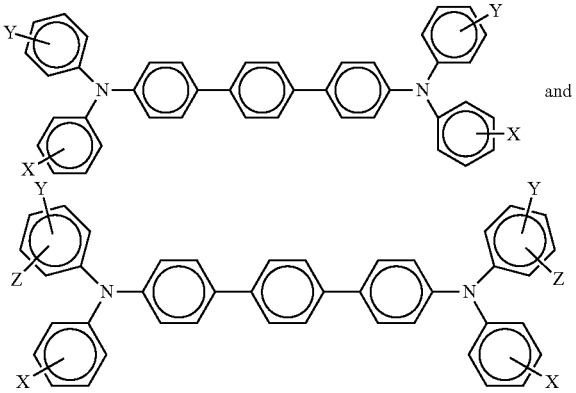

and wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 micrometers, or no more than about 40 micrometers.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In one specific embodiment, the charge transport layer 20 is a solid solution including a charge transport compound, such as N,N'-diphenyl-N,N'-bis(3-methylphenyl)-1,1'-biphenyl-4,4'-diamine, molecularly dissolved in a polycarbonate binder, the binder being either a bisphenol A polycarbonate of poly(4,4'-isopropylidene diphenyl carbonate) or a poly(4,4'-diphenyl-1,1'-cyclohexane carbonate). The Bisphenol A polycarbonate used for typical charge transport layer formulation is MAKROLON which is commercially available from Farbensabricken Bayer A.G and has a molecular weight of about 120,000. The molecular structure of Bisphenol A polycarbonate, poly(4,4'-isopropylidene diphenyl carbonate), is given in Formula (A) below:

Formula (A)

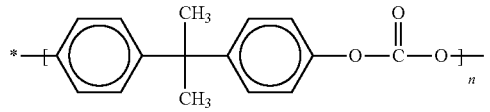

wherein n indicates the degree of polymerization. In the alternative, poly(4,4'-diphenyl-1,1'-cyclohexane carbonate) may also be used as charge transport layer binder in place of MAKROLON. The molecular structure of poly(4,4'-diphenyl-1,1'-cyclohexane carbonate), having a weight average molecular weight of about between about 20,000 and about 200,000, is given in Formula (B) below:

Formula (B)

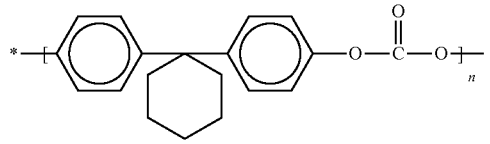

wherein n indicates the degree of polymerization.

Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. Pat. No. 7,018,756 incorporated by reference.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is typically from about 10 micrometers to about 110 micrometers or from about 12 micrometers to about 36 micrometers for optimum photoelectrical and mechanical results. In another embodiment the thickness is from about 14 micrometers to about 36 micrometers.

The fact that the charge transport layer 20 of the imaging member is being the outermost exposed layer, it is subjected to a variety of machine subsystems mechanical actions and exposed to corona effluents (emitted from the charging devices) as well during machine electrophotographic imaging function. Under a normal machine functioning condition in the field, flexible imaging member belt exposure to the ozone species of the corona effluents generated from the wires of machine charging devices is known to cause polymer binder chain scission, exacerbating charge transport layer cracking and wear problems. Charge transport layer wear is also an issue because wear reduces thickness and thereby alters the equilibrium of the balancing forces between the charge transport layer and the anti-curl back coating, impacting imaging member flatness, while cracks formed in the charge transport layer will manifest themselves into copy printout defects.

Of particular importance is that the rigid electrophotographic imaging member drum of the present embodiments uses a contact AC Bias Charging Roller (BCR). Ozone species from BCR attack on the charge transport layer polycarbonate binder and cause the charge transport layer to degrade and en-brittle, resulting in early onset of charge transport wear failure. This result is found to be more pronounced because of the direct physical contact of the BCR to the charge transport layer of the imaging member drum. As a consequence, charge transport layer wear is a serious problem which significantly cuts short the functional life of the imaging member and therefore needs an effective resolution.

To resolve the above-noted shortcomings and issues, a method of fabricating electrophotographic imaging members to produce robust mechanical charge transport layer function has been investigated and successfully demonstrated as described below. The imaging members produced exhibit good wear resistance, cracking life extension, and durability. Such imaging members exhibit enhanced physical/mechanical service life in the field.

In the present disclosure embodiments, the charge transport layer consisting of polycarbonate binder and charge transporting component is further formulated to comprise an added ozone quenching organic compound which is selected to be either a high boiler liquid or a solid. The selected compound for use is also required to be compatible with both the charge transport component and the polycarbonate binder to prevent its phase separation in the coating solution or in the resulting dried charge transport layer, and also not to cause deleterious photoelectrical impact of the prepared imaging member. The ozone quenching compound of choice comprises vinyl or allyl group(s) for effective function as an anti-ozonant to prevent and/or minimize the breaking down of the polycarbonate binder in the charge transport layer caused by molecular chain scission due to ozonolysis. The mechanism of protecting the polymer binder from chain scission degradation against ozone attack, as a result of the incorporation of a vinyl (or allyl) containing organic compound into the charge transport layer, as described above, can be illustrated with reference to the chemical reaction below:

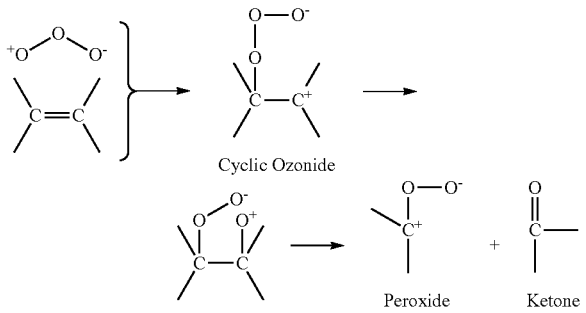

In the case that the ozone quenching compound used is a liquid, it should have a boiling point exceeding 200° C. to ensure its permanent presence in the charge transport layer. Preferably, it is a high boiler that has a boiling point greater than 250° C. In some embodiments, the high boiler liquid has a boiling point of from about 260° C. to about 330° C.

In exemplary embodiments, the ozone quenching compound is selected from one of the following species represented by Formulas (I) to (XIV) below:

Formula (I)

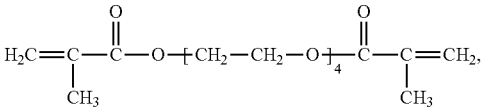

Formual (II)

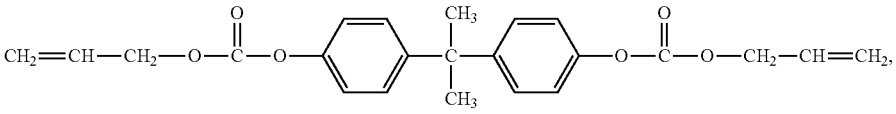

Formula (III)

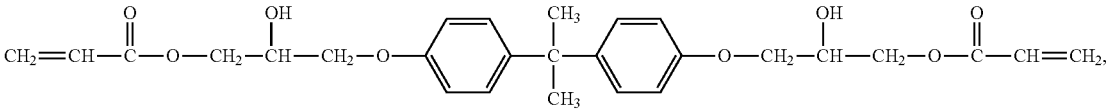

Formula (IV)

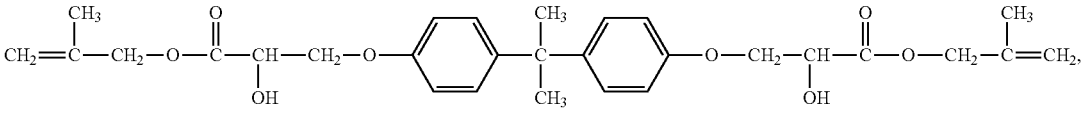

-continued

Formula (V)

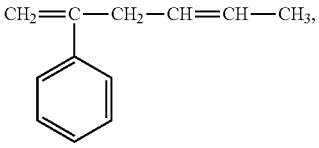

Formula (VI)

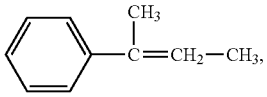

Formula (VII)

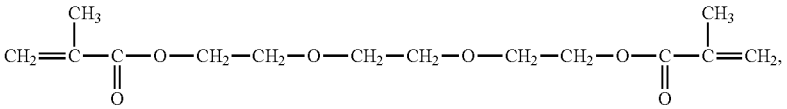

Formula (VIII)

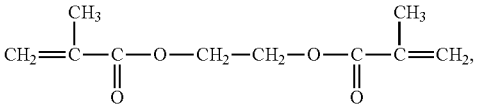

Formula (IX)

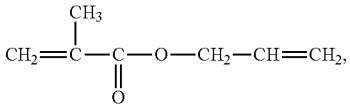

Formula (X)

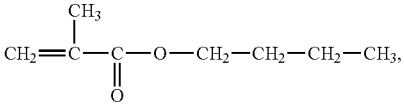

Formula (XI)

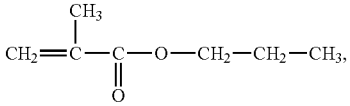

Formula (XII)

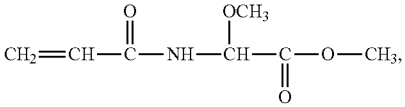

Formula (XIII)

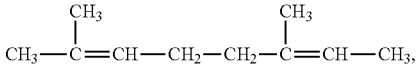

Formula (XIV)

and mixtures thereof.

The ozone quenching organic compound incorporation is from about 0.5 to about 15 weight percent or from about 2 to about 10 weight percent of the charge transport layer, based on the total weight of the charge transport layer. In other embodiments, it comprises from about 4 to about 8 weight percent of the charge transport layer. Mixtures of various ozone quenching compound for addition into the charge transport layer matrix are also contemplated and included in this disclosure. In general, the ratio of the thickness of the charge transport layer to the charge generating layer is maintained from about 2:1 to about 200:1 and in some instances as great as about 400:1. The thickness of the charge transport layer after drying is typically from about 10 to about 110 micrometers or from about 12 to about 36 micrometers for optimum photoelectrical and mechanical results. In another embodiment, the thickness is from about 14 to about 30 micrometers. However, the charge transport layer thicknesses outside this range can also be used provided that there are no adverse effects.

The charge transport layer of present disclosure may further comprise a particulate dispersion to increase wear resistance and photoelectrical performance. Suitable particulates may be organic and inorganic and the dispersion may be a blend of both organic and inorganic particles. Typical organic particulate materials include, but are not limited to, particles of polytetrafluoroethylene (PTFE), waxy polyethylene, waxy polypropylene, stearates, fatty amides, Kevlar™ (aromatic polyamide), and the like; inorganic materials include silica, silicate, calcium carbonate, metal oxides, zinc stearate, and the like. In one embodiment, the particulate dispersion is a PTFE dispersion. The particulates may have an average particle size of micro-dimensions from about 0.1 to about 6 micrometers; however, nanoparticles of from about 3 to about 90 nanometers in average size may also be used. The particulates may have any shape, such as sphere or rod. The particulate dispersion may comprise from about 1 to about 10 weight percent or from about 2 to about 8 weight percent of the charge transport layer, based on the total weight of the charge transport layer. In an exemplary embodiment, the particulate dispersion comprises from about 2 to about 5 weight percent of the charge transport layer. A surfactant may also be added to the charge transport layer coating solution to facilitate homogeneous particulate dispersion. In embodiments where the charge transport layer comprises a particulate dispersion and an organic high boiler ozone quenching compound, wear resistance is synergistically enhanced; therefore, a particulate dispersion is usually included. In one embodiment, the charge transport layer comprises from about 4 to about 8 weight percent organic ozone quenching compound and from about 2 to about 5 weight percent particulate dispersion.

In extended embodiments, the disclosed charge transport layer may comprise additional components. An antioxidant, such as a hindered phenol pentaerythritol tetrakis(3-(3,5-di-tert-butyl-4-hydroxyphenyl)propionate) (available as IRGANOX™ 1010), may be added. The antioxidant can comprise from about 1 to about 15 weight percent of the charge transport layer, based on the total weight of the charge transport layer, but usually does not exceed 8 weight percent. In further extension of embodiments, employing multiple charge transport sublayers, the antioxidant can be present in a concentration gradient reversed from that of the charge transport compound. The charge transport layer may also contain a light shock resisting or reducing agent of from about 1 to about 6 weight percent. Such light shock resisting agents include 3,3',5,5'-tetra(t-butyl)-4,4'-diphenoquinone (DPQ); 5,6,11,12-tetraphenyl naphthacene (Rubrene); 2,2'-[cyclohexylidenebis[(2-methyl-4,1-phenylene)azo]]bis[4-cyclohexyl-(9Cl)]; perinones; perylenes; and dibromo anthanthrone (DBA).

In those embodiments where the charge transport layer comprises dual layers or multiple sublayers, the specific material selected for each component of the sublayer may be independently selected for each sublayer. Typically, the same material is selected for each component of each sublayer and only the amount of the component is varied between sublayers. However, in some embodiments the outermost exposed charge transport layer comprises components different from that of the other sublayers. Generally speaking, the total thickness of a charge transport layer, including dual or multiple layers, ranges from about 10 to about 110 micrometers.

Any suitable technique may be used to mix and apply the charge transport layer coating solution onto the charge generating layer. Generally, the components of the charge transport layer are mixed into an organic solvent. Typical solvents comprise methylene chloride, toluene, tetrahydrofuran, and the like. Typical application techniques include extrusion die coating, spraying, roll coating, wire wound rod coating, and the like. Drying of the coating solution may be effected by any suitable conventional technique such as oven drying, infra red radiation drying, air drying and the like. When the charge transport layer comprises multiple sublayers, each sublayer is solution coated, then completely dried at elevated temperatures prior to the application of the next sublayer. This procedure is repeated for each sublayer to produce the charge transport layer.

The imaging members having the charge transport layer of the present disclosure avoid or minimize attacks by ozone species in the corona effluents to thereby minimize charge transport layer cracking, wear, and defects and deletions in the printed copy; and more specially, wherein there is found to have a significant effect of suppressing polycarbonate binder in the charge transport layer from molecular chain scission caused by ozonolysis to en-brittle the charge transport layer and thereby shortening its mechanical functioning life.

In recapitulation, the rigid imaging member drum designs prepared to comprise the corona resistive charge transport layer in accordance to the method of present disclosure provides wear resistance enhancement against BCR action, while in flexible imaging member belt configurations, the propensity of fatigue charge transport layer cracking is effectively suppressed.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used. Drying of the deposited coating may be effected by any suitable conventional technique such as oven drying, infra red radiation drying, air drying and the like.

In a flexible imaging member belt design, the charge transport layer 20 may have a Young's Modulus in the range of from about $2.5\times10^5$ psi ($1.7\times10^4$ Kg/cm2) to about $4.5\times10^5$ psi ($3.2\times10^4$ Kg/cm2) and also with a thermal contraction coefficient of between about $6.0\times10^{-5}$/° C. and about $8.0\times10^{-5}$/° C. So, the charge transport layer 20 does have a substantially greater thermal contraction coefficient constant compared to that of the support substrate 10 (which is between about $6.0\times10^{-5}$/° C. and about $8.0\times10^{-5}$/° C.), the prepared flexible electrophotographic imaging member will typically exhibit spontaneous upward curling into a 1½ inch roll if unrestrained, after charge transport layer application and through elevated temperature drying then cooling processes, due to the result of larger dimensional contraction in the charge transport layer 20 than the support substrate 10, as the imaging member cools from the glass transition temperature of the charge transport layer down to room ambient temperature of 25° C. after the heating/drying processes of the applied wet charge transport layer coating. Since imaging member curling is undesirable, an anticurl back coating (not shown in FIG. 2) needs to be applied to the backside of the flexible 10 to control curl and render flatness. Although the anti-curl back coating may include any electrically insulating or slightly semi-conductive organic film forming polymer, it is usually the same polymer as used in the charge transport layer polymer binder. An anti-curl back coating from about 7 to about 30 micrometers in thickness is found to be adequately sufficient for balancing the curl and render imaging member flatness.

However, for drum imaging member designs, thick and rigid drums are used as substrate support, so no application of anti-curl back coating is required.

The Overcoat Layer

Figure 2:
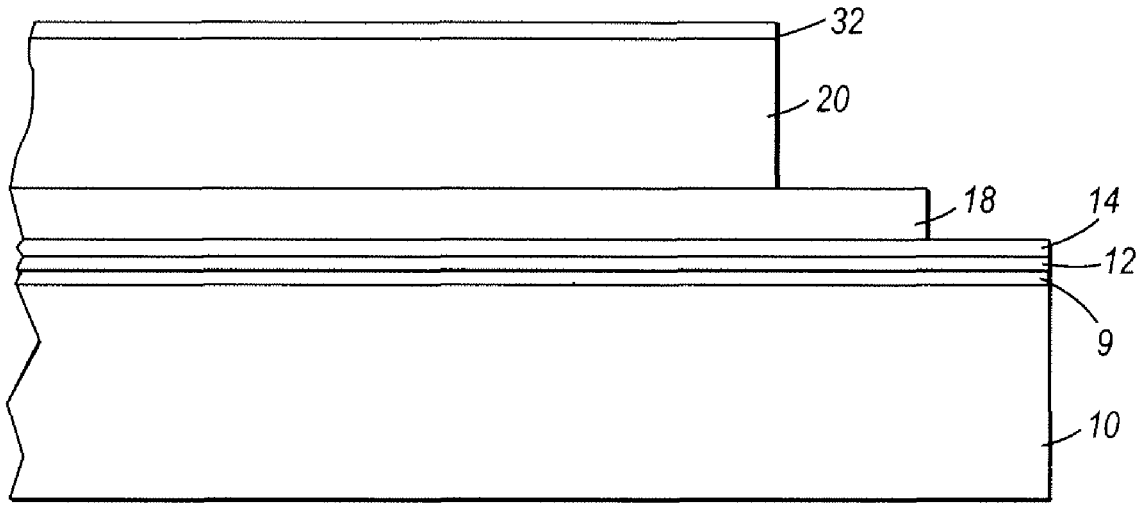
FIG. 2 illustrates a drum electrophotographic imaging member showing various layers in accordance with the present embodiments.

To further render mechanical service life extension, an optional overcoat layer 32 may be disposed over the charge transport layer 20 of the imaging member of FIG. 2 to provide imaging member surface protection against chemical species attack as well as improve resistance to abrasion/wear failure. The inclusion of the overcoat layer is intended to complement the mechanically robust charge transport layer formulated according to the methodology of present disclosure. The imaging member thus created will therefore become an ultimate imaging member design which provides additional wear resistance enhancement to reach its targeted life goal or farther beyond, free of abrasion/wear and cracking failures. In these embodiments, the overcoat layer 32 may have a thickness ranging from about 0.1 micrometer to about 10 micrometers or from about 1 micrometer to about 10 micrometers, or in a specific embodiment, about 3 micrometers. The overcoating layer may include thermoplastic organic polymers or inorganic polymers that are electrically insulating or slightly semi-conductive. For example, the overcoat layer may be fabricated from a dispersion including a particulate additive in a resin. Suitable particulate additives for overcoat layers include metal oxides including aluminum oxide, non-metal oxides including silica or low surface energy polytetrafluoroethylene (PTFE), and combinations thereof. Suitable resins include those described above as suitable for photogenerating layers and/or charge transport layers, for example, polyvinyl acetates, polyvinylbutyrals, polyvinyichlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoating layers may be continuous and have a thickness of at least about 0.5 micrometer, or no more than 10 micrometers, and in further embodiments have a thickness of at least about 2 micrometers, or no more than 6 micrometers.

The flexible imaging member belt or rigid drum imaging member, prepared according to the descriptions of this disclosure, may then be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member of this disclosure. Thus, by applying a suitable electrical bias and selecting toner having the appropriate polarity of electrical charge, one may form a toner image in the charged areas or discharged areas on the imaging surface of the electrophotographic member of the present disclosure.

Therefore, the present embodiments provide a robust imaging member for effective service life extension, and methods of fabricating the same. The present approach has been developed and successfully demonstrated to yield imaging member service life improvements by providing a charge transport layer (1) having ozone quenching/corona resistive capability, (2) having enhanced wear resistance through use of organic or inorganic particulates dispersion, and (3) incorporating an anti-oxidant agent and light shock suppression compound, each of which is described in this disclosure. In extended embodiments, the disclosed charge transport layer may also be coated over with a mechanically robust protective overcoating layer to complementally provide wear resistance addition. Therefore, the resulting synergistic mechanical enhancement thus achieved would enable the imaging member to make further service life extension for reaching its targeted service life goal or beyond.

The development of the present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Flexible Imaging Member Preparation

Control Example 1

A flexible electrophotographic imaging member web was prepared by providing a 0.02 micrometer thick titanium layer coated on a substrate of a biaxially oriented polyethylene naphthalate substrate (KADALEX, available from DuPont Teijin Films. (Tokyo, Japan)) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsutsu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer dispersion was prepared by adding 0.45 gram of IUPILON 200, a polycarbonate of poly(4,4'-diphenyl)-1,1'-cyclohexane carbonate (PC-z 200, available from Mitsubishi Gas Chemical Corporation (Tokyo, Japan)), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This charge generating layer comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

The coated web stock was simultaneously coated over with a charge transport layer and a ground strip layer by co-extrusion of the coating materials. The charge transport layer was prepared by introducing into an amber glass bottle in a weight ratio of 1:1 (or 50 weight percent of each) of MAKROLON® 5705, a Bisphenol A polycarbonate thermoplastic having a molecular weight of about 120,000 commercially available from Farbenfabriken Bayer A.G. (Leverkusen, Germany) and N,N'-diphenyl-N,N'-bis(3-methylphenyl)-1,1'-biphenyl-4,4'-diamine, a charge transport compound.

The resulting mixture was dissolved to give 15 percent by weight solid in methylene chloride. This solution was applied on the charge generating layer by extrusion to form a coating which upon drying in a forced air oven gave a charge transport layer 29 micrometers thick.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (MAKROLON® 5705, 7.87 percent by total weight solids, available from Bayer A.G. (Leverkusen, Germany)), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company (Port Huron, Mich.)) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the charge transport layer, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the charge transport layer and the ground strip.

An anti-curl coating was prepared by combining 88.2 grams of polycarbonate resin (MAKROLON® 5705), 7.12 grams VITEL PE-200 copolyester (available from Goodyear Tire and Rubber Company (Akron, Ohio)) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and charge transport layer) of the electrophotographic imaging member web by extrusion coating and dried to a maximum temperature of 125° C. in a forced air oven for 3 minutes to produce a dried coating layer having a thickness of 17 micrometers and flatten the imaging member.

Control Example 2

A flexible electrophotographic imaging member web was prepared in the same manner and using the same materials as those described in Control Example 1, except that the 29 micrometers thick charge transport layer was prepared to include a 5 wt-% nanoparticle PTFE (known as MP1100, available from DuPont (Wilmington, Del.)) dispersion.

Example 1

Two flexible electrophotographic imaging member webs were fabricated using the same materials and the same process as that described in Control Example 2, except that the charge transport layer coating solutions were prepared to include a —CH═$CH_2$ (vinyl) terminal groups containing Bisphenol A bisallyl carbonate monomer (known as HIRI®, commercially available from PPG Industries (Pittsburgh, Pa.)), an organic high boiler liquid. The two coating solutions were then each applied onto the charge generating layer of an imaging member web and followed by subsequent drying at elevated temperature to give two imaging member web stocks having 2 wt-% HIRI® and 8 wt-% HIRI®, respectively, based on the resulting dried weight of each charge transport layer. The charge transport layer of each web was 29 micrometers in thickness. The Bisphenol A bisallyl carbonate monomer HIRI®, containing the two —CH═$CH_2$ (vinyl) terminal groups, has a molecular formula shown below:

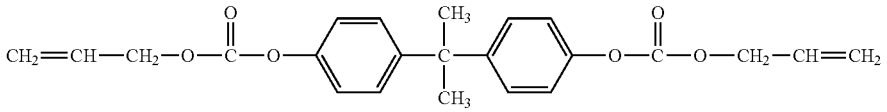

Example 2

A flexible electrophotographic imaging member web was fabricated using the same materials and the same process as that described in the Control Example 1, except that the charge transport layer coating contained 5 wt-% nano particle PTFE dispersion and 5 wt-% HIRI®. The charge transport layer was also 29 micrometers thick.

Photoelectrical and Ozone Exposure Testing

The imaging member webs of Control Example 1 and Example 1 were tested to determine the effect of incorporating a high boiler liquid on photoelectrical properties.

The photoelectrical testing results obtained from the electrical scanner showed that electrophotographic imaging members containing HIRI® exhibited equivalent electrical functional characteristics, such as photoelectrical cyclic stability, charge acceptance, photo induce discharge sensitivity, dark decay potential, depletion voltage, and background and residual voltage compared to their respective imaging member control counterpart. These results indicate that the incorporating a high boiler liquid into the charge transport layer would not cause deleterious photoelectrical impacts that affect imaging member function, since HIR®I has a molecular structure that is substantial the same as the MAKROLON® binder in the charge transport layer.

To assess the extent of polycarbonate degradation as a result of ozone exposure, two sets of two freestanding coatings were prepared by solution casting. The coatings were 20 micrometers thick. Each set contained one coating of pure MAKROLON® and one coating of MAKROLON® with 5 wt-% HIRI® incorporated. One set was subjected to an ozone exposure test from corona effluent and the other unexposed set was used as a control. Corona effluents were generated by turning on a charging device in an enclosed large glass tubing operated under 700 micro-amperes and 8 KV conditions. The corona effluent exposure test was accomplished by placing each coating inside the enclosed glass tube and simultaneously exposing the coating to the gaseous effluents generated by the charging device for 6 hours. All four coatings were then analyzed for molecular weight distribution by Gel Permeation Chromatography (GPC). The results are given in Table 1 below.

TABLE 1

| IMAGING MEMBER ID | $M_w$ (Kpse) | $M_n$ (Kpse) | $M_p$ (Kpse) |
|---|---|---|---|
| Makrolon/HIRI ® corona exposed | 90.7 | 4.1 | 133 |
| Makrolon/HIRI ® control (unexposed) | 163 | 37 | 146 |
| Makrolon control corona exposed | 30.1 | 4.9 | 37.6 |
| Makrolon control (unexposed) | 163 | 40 | 140 |

In the above table, $M_w$ is weight average molecular weight, $M_n$ is number average molecular weight, and $M_p$ is the peak molecular weight. The data showed that molecular degradation caused by ozone attack in the pure MAKROLON® coating was significant, while addition of HIRI® in MAKRO- LON® provided effective protection against polymer chain scission caused by ozonolysis as seen in the $M_w$ and $M_n$ columns.

The aim of the experimental study was to determine the impact of ozone attack on the charge transport layer mechanical degradation of the imaging member and the effectiveness of the —CH═$CH_2$ (vinyl) terminal groups in ozone quenching compounds, such as for example, the HIRI® carbonate molecules, to quench/suppress ozone attack on the charge transport layer by protecting the polycarbonate binder from chain scission according to the following chemical reaction:

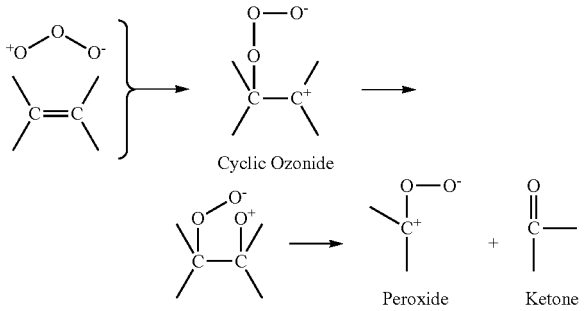

The ozone quenching effectiveness and/or capability of —CH═$CH_2$ (vinyl) terminal groups in the HIRI® carbonate molecules on the impact of charge transport wear life extension were then assessed and carried out by corona effluents/imaging member exposure test as further described below.

The corona effluent exposure test was also performed on imaging members after being left standing for two months. The imaging members of Control Examples 1 and 2, along with the imaging members of Examples 1 and 2, were first allowed to sit on the shelf for 2 months and then cut to provide two sets of two 1"×12" test samples from each of these four imaging members. Each of the imaging member test samples, laid down in flat configuration (without bending) on a surface of a support with the charge transport layer facing upwardly, was then subjected to a corona effluent exposure test. Corona effluents were generated by turning on a charging device in an enclosed large glass tubing operated under 700 micro-amperes and 8 KV conditions. One set of each imaging member test sample was placed inside the enclosed glass tube and the samples were simultaneously exposed to the gaseous effluents generated by the charging device for 6 hours. Examination of each of these test samples, under 70× magnification with an optical microscope, after exposure, found that all the test samples, of both the Control Examples 1 and 2 and the Examples 1 and 2, did not develop cracking in their charge transport layer even though MAKROLON® chain scission did occur as a result of ozone attacking the layer; this was due to the fact that the test samples were exposure tested with each samples being laid down under flat configuration condition free of bending strain.

To assess the impact of polymer degradation on the wear properties of the charge transport layer (CTL), both the exposed and unexposed imaging member samples were then subjected to wear testing.

The wear testing of each of the electrophotographic imaging member test samples after corona exposure was conducted by means of a dynamic mechanical cycling device in which glass tubes were skidded across the surface of the charge transport layer on each imaging member. More specifically, one end of the test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch (0.17 kilogram per cm) width tension on the sample. The outer surface of the imaging member cut piece bearing the charge transport layer faced downwardly so that it would periodically be brought into sliding mechanical contact with the glass tubes to effect wear. The glass tubes had an outer diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the outer surface of the charge transport layer. The axis of each glass tube was positioned about 4 cm from the shaft. The direction of movement of the glass tubes along the charge transport layer (CTL) surface was away from the weighted end of the sample toward the end clamped to the stationary post. Since there were three glass tubes in the test device, each complete rotation of the disk was equivalent to three wear cycles in which the surface of the charge transport layer was in sliding mechanical contact with a single stationary support tube during the testing. The rotation of the spinning disk was adjusted to provide the equivalent of 11.3 inches (28.7 cm.) per second tangential speed. The extent of charge transport layer (CTL) wear was measured using a permascope at the end of a 90K wear cycles test. The results are given in Table 2 below.

TABLE 2

| IMAGING MEMBER ID (after corona exposure) | AMOUNT PTFE IN CTL | AMOUNT HIRI ® IN CTL | CTL WORN OFF BY 90K wear cycles |
|---|---|---|---|
| Control 1 | none | none | 4.2 microns |
| Control 2 | 5 wt-% | none | 2.6 microns |
| Example 1 | none | 8 wt-% | 2.9 microns |
| Example 2 | 5 wt-% | 5 wt-% | 1.9 microns |

The wear data, obtained for all these samples after corona exposure, demonstrated that (1) addition of a PTFE dispersion provided substantial charge transport layer wear improvement; (2) addition of HIRI® improved wear resistance nearly equivalent to that of the 5 wt-% PTFE dispersion; and (3) a charge transport layer prepared to have both PTFE dispersion and —CH═$CH_2$ (vinyl) terminal groups containing HIRI® incorporation gave synergistically superior wear enhancement outcome over the control.

Additionally, it is also important to note that CTL formulated to include addition of PTFE dispersion and the antiozonant HIRI® liquid carbonate to give outstanding wear resistance enhancement did not cause deleterious impact to the overall photo-electrical performance. Neither was seen to affect the interfacial adhesion bonding strength between the charge transport layer and the charge generation layer.

Imaging Member Drum Preparation

Control Example A

An electrophotographic photoreceptor was fabricated in the following manner. A coating solution for an undercoat layer comprising 100 parts of a ziconium compound (trade name: Orgatics ZC540), 10 parts of a silane compound (trade name: A110, manufactured by Nippon Unicar Co., Ltd), 400 parts of isopropanol solution and 200 parts of butanol was prepared. The coating solution was applied onto a cylindrical aluminum (Al) substrate subjected to honing treatment by dip coating, and dried by heating at 150° C. for 10 minutes to form an undercoat layer having a film thickness of 0.1 micrometer.

A 0.5 micron thick charge generating layer was subsequently dip coated on top of the undercoat layer from a dispersion of Type V hydroxygallium phthalocyanine (12 parts), alkylhydroxy gallium phthalocyanine (3 parts), and a vinyl chloride/vinyl acetate copolymer, VMCH (Mn=27,000, about 86 weight percent of vinyl chloride, about 13 weight percent of vinyl acetate and about 1 weight percent of maleic acid) available from Dow Chemical (10 parts), in 475 parts of n-butylacetate.

Subsequently, a 25 micrometer thick charge transport layer (CTL) was dip coated on top of the charge generating layer from a solution of N,N'-diphenyl-N,N'-bis(3-methylphenyl)-1,1'-biphenyl-4,4'-diamine (82.3 parts), 2.1 parts of 2,6-di-tert-butyl-4-methylphenol (BHT) from Aldrich and a polycarbonate, PCZ-400 [poly(4,4'-dihydroxy-diphenyl-1-1-cyclohexane), $M_w$=40,000] available from Mitsubishi Gas Chemical Company, Ltd. (123.5 parts) in a mixture of 546 parts of tetrahydrofuran (THF) and 234 parts of monochlorobenzene. The CTL was dried at 115° C. for 60 minutes.

Example A

An imaging member drum was fabricated using the same materials and the same process as that described in the Control Example A, except that the charge transport layer coating contained 5% and 10% HIRI® to the solid content by weight.

Initial studies have been completed in which a material solution of charge transport layer (CTL) comprised of a charge transporting molecule of N,N'-diphenyl-N,N'-bis(alkylphenyl)-1,1-biphenyl-4,4'-diamine and a polycarbonate was doped with 5% and 10% HIRI® to the solid content by weight. The HIRI® was added to the CTL and then allowed to roll overnight to ensure good mixing. The CTL's were then used in the coating of full photoreceptor devices where the CTLs comprised, in order of coating, a 4 micrometer titanium oxide based undercoating layer, a chlorogallium phthalocyanine based charge generation layer, and a 24 micrometer CTL. Both the 5% and 10% doped CTL's were coated at 24 um. A control device with standard CTL without the HIRI® dopant at 24 urn was also coated.

Photoelectrical and Ozone Exposure Testing

These devices were electrically scanned and print tested at time zero. Photoelectrical properties of devices containing 0, 5%, or 10% HIRI® are all nominal, suggesting HIRI® is compatible to other components of the CTL and not inducing charge traps or phase boundary. The devices were then placed in a wear test fixture for two sets of 50 kcycles each. The thickness of each device was monitored via Permiscope. Wear rate results indicate a 15-20% improvement when the CTL was doped with 5% or 10% HIRI®. After each 50 kcycle run the photoreceptor was taken from the fixture and print tested for background and ghosting in a Document Center 230ST printer. All the print tests completed gave background levels of 1.5 and ghosting grades of 0. The 1.5 background level was given since all the prints had a small amount of background, but not as much as the level 2 standard. All prints were comparable to the machine control prints and all showed good general print quality, suggesting the HIRI® was an effective antiozonant to provide the CTL with good resistance to Bias Charging Roll (BCR) action without incur any copy printout quality degradations (shown in Table 3). A bias charging roll was an apparatus electrically connected to a current voltage source and comprised of a deformable conductive and maintained in contact with any given area of an imaging member to charge the imaging member.

TABLE 3

Print background and ghosting result for members having 0, 5, and 10% HIRI ® in CTL

| Print Test | HIR Loading | T = 0 | | T = 50K | | T = 100K | |
|---|---|---|---|---|---|---|---|
| Device | (%) | Background | Ghost | Background | Ghost | Background | Ghost |
| 03217501SDC | 0 | 1.5 | 0 | 1.5 | 0 | 1.5 | 0 |
| 03217502SDC | 5 | 1.5 | 0 | 1.5 | 0 | 1.5 | 0 |
| 03217503SDC | 10 | 1.5 | 0 | 1.5 | 0 | 1.5 | 0 |
| Control | 0 | 1.5 | 0 | 1.5 | 0 | 1.5 | 0 |

Therefore, a more BCR resistance CTL by doping HIRI® resin had been demonstrated. A 15-20% improvement in BCR wear rate without any deterioration to print quality is observed when doped 5 or 10% HIRI® into a regular CTL. The process of adding HIRI® was simple mixing and did not require any sophisticated and hard-to-maintain procedures such as PTFE CTL.

Details of the device preparation are described here. The PTFE microparticles used was the recently identified nanoFLON P51A, manufactured by Shamrock Technologies (Newark, N.J.). An about 100 g PTFE slurry was made by first mixing 20 gm of nanoFLON particles and 38.4 gm solution of 1% GF-300-a graft co-polymer surfactant manufactured by Togaosei Company (Tokyo, Japan) known to dispersion PTFE particles-in THF and another 45 gm of THF overnight. Separately, a charge transport (CTL) solution consisted of 24 g of N,N'-diphenyl-N,N'-bis(alkylphenyl)-1,1-biphenyl-4,4'-diamine and 36 gm of polycarbonate in 156 gm of THF and 84 gm toluene was mixed and allowed to dissolve. The PTFE slurry was processed in Cavpro 300, a homogenizer, for 3 passes then about 25 gm of the dispersion was added to the above solution, which then processed in the homogenizer for another two passes. The PTFE CTL dispersion was collected and yielded a solid content of about 18%. Subsequently, 0.3 gm of HIR®I I Casting resin (by PPG Industries) was added to a 30 gm of PTFE CTL dispersion, which will be named as PTFE/HIR®I CTL dispersion hereafter, and allowed to mixed overnight. Separately, control samples were also made with a CTL solution similar to the above CTL solution but at a higher 22% solids and a PTFE CTL dispersion similar to the above PTFE CTL dispersion but at a solid of 20%. Several devices were coated with the above dispersions/solution on the same charge generating layer consisted of hydroxygallium phthalocyanine and vinyl chloride/acetate and undercoating layer consisted of silane, acetylacetonato zirconium, and polyvinyl butyral on 30 mm diameter aluminum pipes. Photoinduced discharged characteristics obtained for the three devices had shown that incorporating nanoFLON and HIRI® does not affect photoelectrical properties since all had similar curves.

Table 4 summarizes details of the photoelectrical properties which again indicate nominal properties for nanoFLON and HIRI®. Devices were charged to 700 V scanned at a RPM of 61.

TABLE 4

Key Photoelectrical Properties of nanFLON and nanoFLON/HIRI ® Devices.

| Drum Imaging Member ID | dV/dX ($Vcm^2$/ergs) | $V_L$ (1.3 ergs) | $V_R$ | $V_{dep}$ |
|---|---|---|---|---|
| Reg. CTL | 290 | 350 | 88 | 77 |
| PTFE CTL | 292 | 352 | 90 | 80 |
| PTFE/HIRI CTL | 286 | 356 | 95 | 75 |

BCR wear rates for these devices were tested in a Hodaka wear test fixture with the same kind of cartridge and the results are shown in FIG. 6. A substantial 25% improvement in wear rate has been observed for the device with both nanoFLON and HIR®I over the one with only nanoFLON dopant. The nanoFLON/HIRI® device also had a 24% better wear rate than the device with standard CTL.

In summary, CTL incorporated with HIRI® and PTFE particles dispersion did effect significant wear rate improvement without any apparent changes to key xerographic properties.

In accordance to the results obtained in all Examples described above, corona and wear resistance enhanced charge transport layer of present disclosure could conceptually be formulated by incorporation a —CH═$CH_2$ (vinyl) or —CH═CH— containing organic compound into the material matrix of the layer. The organic compounds of interest is either a high boiler liquid or solid having the inherent ozone quenching capability is to be selected from one of Formulas (I) to (XIV) listed below:

Formula (I)

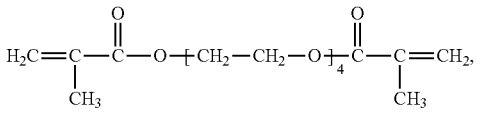

Formula (II)

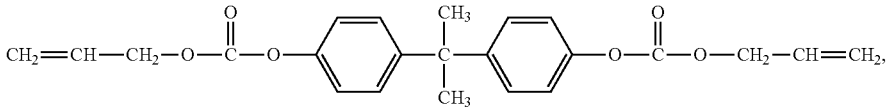

Formula (III)

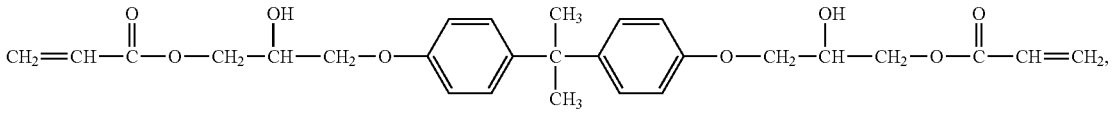

Formula (IV)

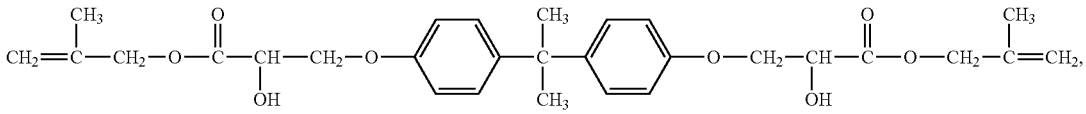

Formula (V)

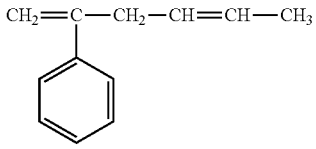

Formula (VI)

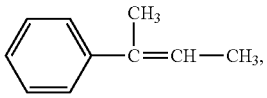

Formula (VII)

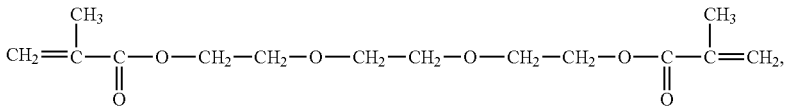

Formula (VIII)

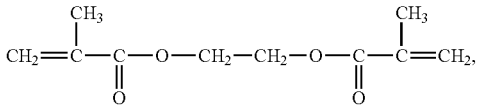

Formula (IX)

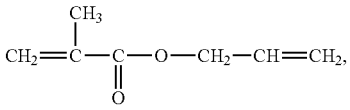

-continued

Formula (X)

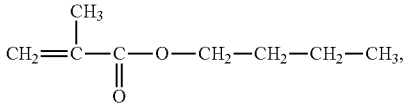

Formula (XI)

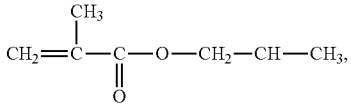

Formula (XII)

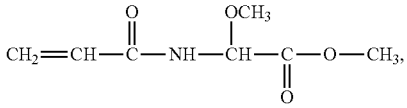

Formula (XIII)

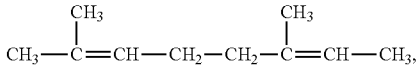

Formula (XIV)

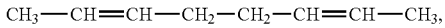

and mixtures thereof.

The imaging member having the disclosed charge transport layer formulation thus prepared provides effective wear resistance enhancement against the BCR action as well as cracking suppression under a normal imaging member machine functioning condition.

Imaging members of the present disclosure may also include an overcoating layer over the charge transport layer formulated in accordance with the present embodiments. The overcoat layer is from about 1 to about 10 micrometers in thickness, or between about 2 and about 5 micrometers to impart optimum added wear resistance without adversely impacting photoelectrical function and copy print out quality.

An overcoat formulation was prepared from a mixture of an acrylic polyol (1.5 parts, JONCRYL-587, available from Johnson Polymers LLC (Sturtevant, Wis.), a melamine resin (2.1 parts, CYMEL-303 available from Cytec Industries, Inc. West Paterson, N.J.), a charge transport component of N,N,N',N'-tetrakis-[(4-hydroxymethyl)phenyl]-biphenyl-4,4'-diamine (THM-TBD)(1.16 parts)/N,N'-diphenyl-N,N'-di(3-hydroxyphenyl)-terphenyl-diamine (DHTER)(1.93 pats), and an acid catalyst (0.05 part, Nacure 5225 available from King Chemical Industries (Norwalk, Conn.)), in a solvent of 1-methoxy-2-propanol (20.9 parts).

The solution was applied onto the photoreceptor surface and more specifically onto the charge transport layer, using cup coating technique. Finally thermal curing was done at 140° C. for 40 minutes to form an overcoat layer having an average film thickness of about 6 micrometers.

The disclosed imaging member prepared to have a corona resistance charge transport layer formulation and complemented with a mechanical robust overcoat addition provides maximum improvement to eliminate pre-mature mechanical failures and impact the imaging member's functioning life enhancement to meet the targeted service life requirement in the field.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a substrate;

a charge generating layer disposed on the substrate;

at least one charge transport layer disposed on the charge generating layer, wherein the charge transport layer comprises a polycarbonate binder, a charge transport compound of N,N'-diphenyl-N,N'-bis(3-methylphenyl)-1,1-biphenyl-4,4'-diamine, and an ozone quenching compound, and further wherein the ozone quenching compound is miscible with both the polycarbonate and N,N'-diphenyl-N,N'-bis(3-methylphenyl)-1,1-biphenyl-4,4'-diamine; and an overcoat layer disposed over the charge transport layer, wherein the overcoat layer is crosslinked.

2. The imaging member of claim 1, wherein the polycarbonate binder in the charge transport layer is selected from the group consisting of a bisphenol A polycarbonate of poly(4,4'-isopropylidene diphenyl carbonate) having a molecular formula of

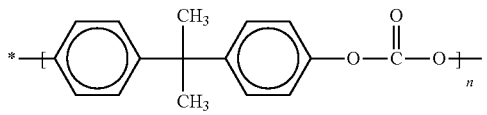

and a weight average molecular weight of about 120,000, a poly(4,4'-diphenyl-1,1'-cyclohexane carbonate) having a molecular formula of

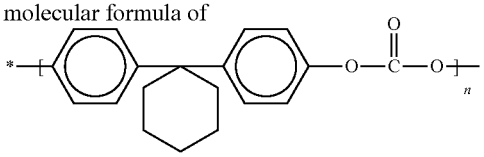

and a weight average molecular weight of between about 20,000 and about 200,000, and mixtures thereof, wherein n indicates the degree of polymerization.

3. The imaging member of claim 1, wherein the ozone quenching compound comprises a vinyl or allyl group.

4. The imaging member of claim 3, wherein the ozone quenching compound is a high boiler liquid having a boiling point exceeding 200° C.

5. The imaging member of claim 3, wherein the ozone quenching compound is a solid.

6. The imaging member of claim 3, wherein the ozone quenching compound is selected from the group consisting of one of the following species represented by Formulas (I) to (XIV) below:

Formula (I)

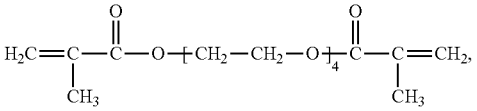

Formula (II)

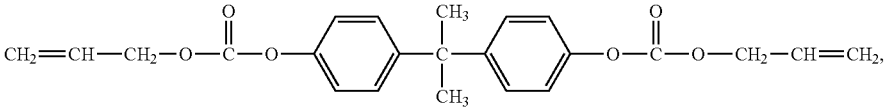

Formula (III)

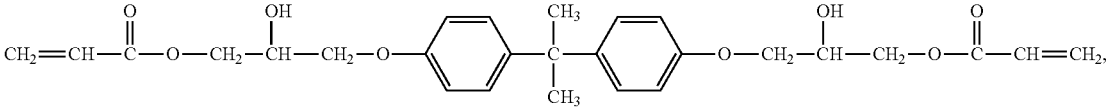

Formula (IV)

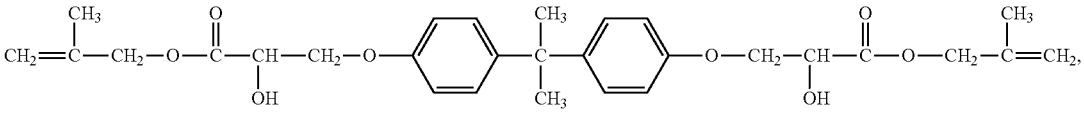

Formula (V)

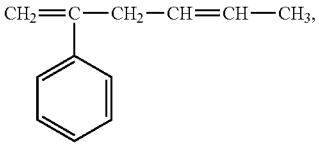

Formula (VI)

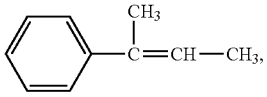

Formula (VII)

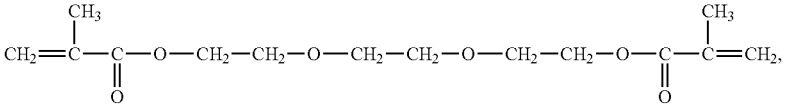

Formula (VIII)

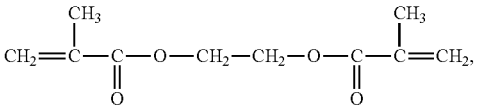

Formula (IX)

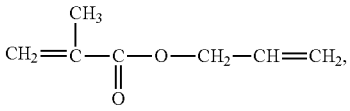

Formula (X)

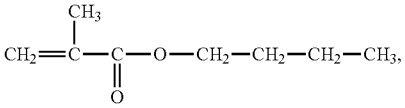

Formula (XI)

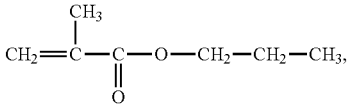

Formula (XII)

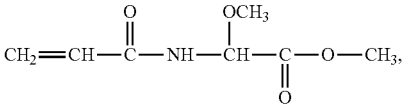

Formula (XIII)

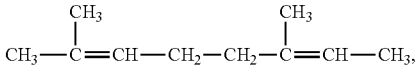

Formula (XIV)

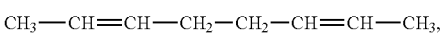

and mixtures thereof.

7. The imaging member of claim 1, wherein the ozone quenching compound is present in the charge transport layer in an amount of from about 0.5 percent to about 15 percent by weight of the total weight of the charge transport layer.

8. The imaging member of claim 1, wherein charge transport layer comprises the polycarbonate and the charge transport compound in a weight ratio of 50/50.

9. The imaging member of claim 1, wherein the charge transport layer further comprises an organic or an inorganic particulate dispersion.

10. The imaging member of claim 9, wherein the organic or inorganic particulate dispersion has an average particle size of from about 0.1 to about 6 micrometers.

11. The imaging member of claim 9, wherein the organic particulate dispersion comprises polytetrafluoroethylene and the inorganic particulate dispersion comprises silica.

12. The imaging member of claim 9, wherein the organic or inorganic particulate dispersion is present in the charge transport layer in an amount of from about 1 percent to about 10 percent by weight of the total weight of the charge transport layer.

13. The imaging member of claim 9, wherein the ozone quenching compound is present in an amount of from about 4 percent to about 8 percent by weight of the charge transport layer and the organic or inorganic particulate dispersion is present in an amount of from about 2 percent to about 5 percent by weight of the charge transport layer.

14. The imaging member of claim 1, wherein the charge transport layer further comprises an antioxidant of hindered phenol in an amount of from about 1 percent to about 15 percent by weight of the charge transport layer.

15. The imaging member of claim 14, wherein the antioxidant of hindered phenol is pentaerythritol tetrakis(3-(3,5-di-tert-butyl-4-hydroxyphenyl)propionate).

16. The imaging member of claim 1, wherein the charge transport layer further comprises a light shock resisting agent present in an amount of from about 1 to about 6 weight percent of the charge transport layer.

17. The imaging member of claim 16, wherein the light shock resisting agent is selected from one of the group consisting of 3,3',5,5'-tetra(t-butyl)-4,4'-diphenoquinone (DPQ), 5,6,11,12-tetraphenyl naphthacene (Rubrene), 2,2'-[cyclohexylidenebis[(2-methyl-4,1-phenylene)azo]]bis[4-cyclohexyl-(9Cl)], perinones, perylenes, and dibromo anthanthrone (DBA).

18. The imaging member of claim 1, wherein the overcoat layer comprises a hydroxyl-containing charge transport molecule, a polyol polymer binder, and a melamine-based curing agent.

19. An imaging member comprising:

a substrate;

a charge generating layer disposed on the substrate;

at least one charge transport layer disposed on the charge generating layer; and a crosslinked overcoat layer disposed over the charge transport layer, wherein the charge transport layer comprises a polycarbonate binder, a charge transport compound of N,N'-diphenyl-N,N'-bis(3-methylphenyl)-1,1-biphenyl-4,4'-diamine, and an ozone quenching compound, and further wherein the ozone quenching compound is selected from the group consisting of one of the following species represented by Formulas (I) to (XIV) below:

Formula (I)

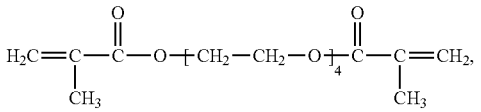

Formula (II)

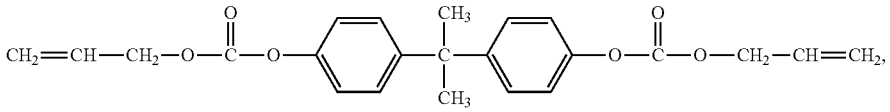

Formula (III)

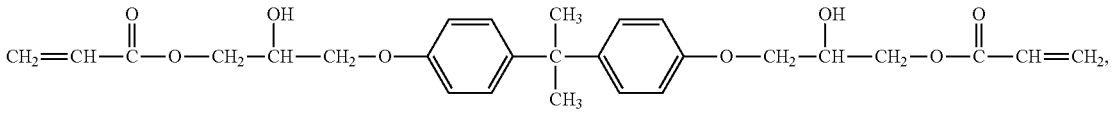

Formula (IV)

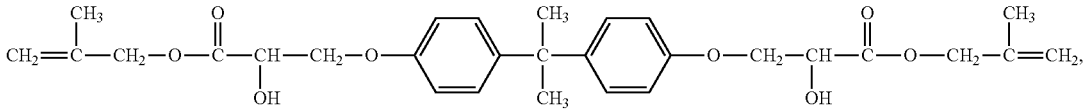

Formula (V)

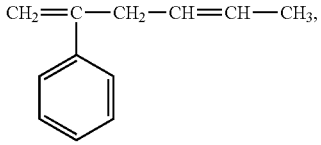

Formula (VI)

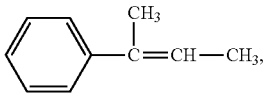

Formula (VII)

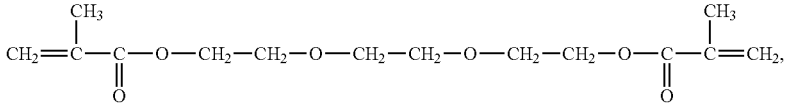

-continued

Formula (VIII)

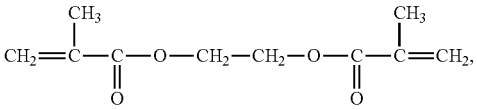

Formula (IX)

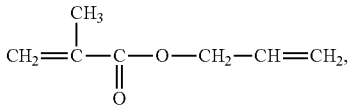

Formula (X)

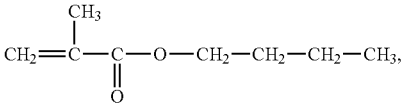

Formula (XI)

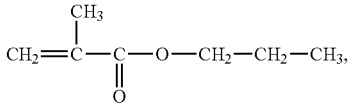

Formula (XII)

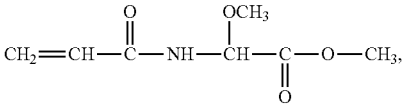

Formula (XIII)

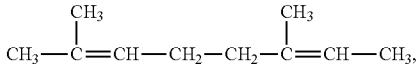

Formula (XIV)

and mixtures thereof.

20. An imaging member comprising:

a substrate;

a charge generating layer disposed on the substrate;

a charge transport layer disposed on the charge generating layer; and a crosslinked overcoat layer disposed on the charge transport layer, wherein the charge transport layer has multiple layers and each layer comprises a polycarbonate binder, a charge transport compound of N,N'-diphenyl-N,N'-bis(3-methylphenyl)-1,1-biphenyl-4,4'-diamine, and an ozone quenching compound, and further wherein the ozone quenching compound is selected from the group consisting of one of the following species represented by Formulas (I) to (XIV) below:

Formula (I)

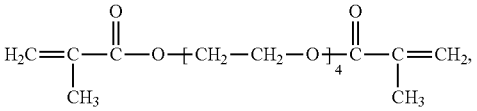

Formula (II)

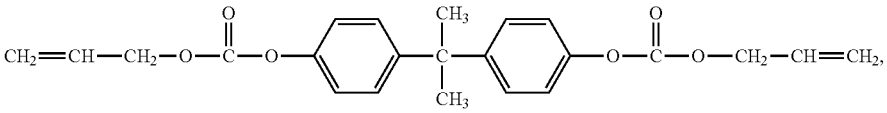

Formula (III)

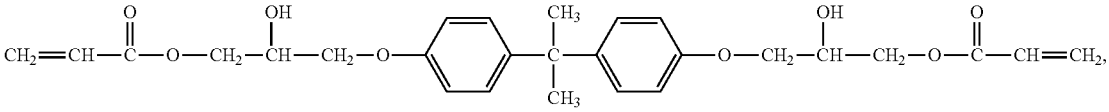

Formula (IV)

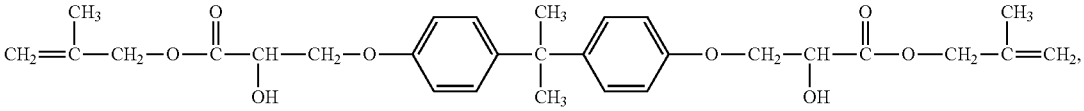

Formula (V)

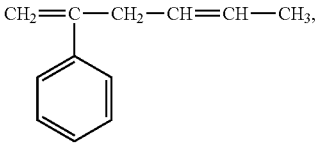

Formula (VI)

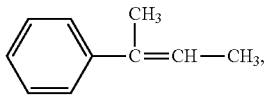

Formula (VII)

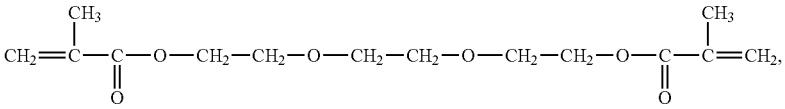

-continued
Formula (VIII)
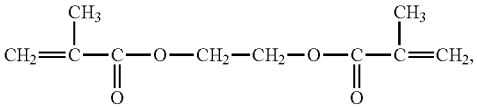
Formula (IX)
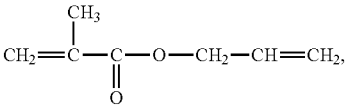
Formula (X)
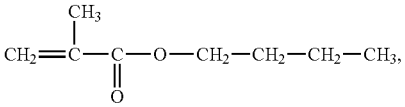
Formula (XI)
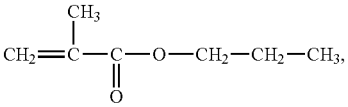
Formula (XII)
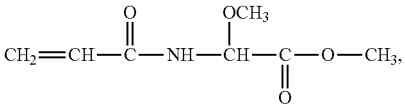
Formula (XIII)
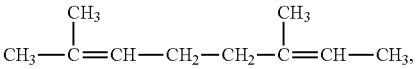
Formula (XIV)
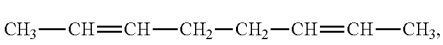
and mixtures thereof.
* * * * *